US008151811B2

(12) United States Patent
Chong

(10) Patent No.: US 8,151,811 B2
(45) Date of Patent: Apr. 10, 2012

(54) PROTECTIVE MECHANISM FOR AUTOMATIC UMBRELLA

(75) Inventor: Jung Jen Chong, Fujian (CN)

(73) Assignee: Xiamen Futai Umbrella Industries Ltd., Fujian (CN)

( * ) Notice: Subject to any disclaimer, the term of this patent is extended or adjusted under 35 U.S.C. 154(b) by 0 days.

(21) Appl. No.: 12/259,388

(22) Filed: Oct. 28, 2008

(65) Prior Publication Data

US 2009/0133729 A1 May 28, 2009

(30) Foreign Application Priority Data

Nov. 23, 2007 (CN) ..... 2007 1 0009892

(51) Int. Cl.
*A45B 25/16* (2006.01)

(52) U.S. Cl. ..... 135/20.3; 135/22

(58) Field of Classification Search ..... 135/15.1, 135/22, 24, 25.4, 25.41
See application file for complete search history.

(56) References Cited

U.S. PATENT DOCUMENTS

| | | | | |
|---|---|---|---|---|
| 5,711,333 | A * | 1/1998 | Vanderminden, Sr. | 135/20.3 |
| 7,798,160 | B2 * | 9/2010 | Chen | 135/24 |
| 7,971,595 | B1 * | 7/2011 | Ko | 135/24 |
| 2010/0288317 | A1 * | 11/2010 | Huang | 135/24 |
| 2011/0114142 | A1 * | 5/2011 | Cai | 135/22 |
| 2011/0192435 | A1 * | 8/2011 | Ko | 135/24 |
| 2011/0226295 | A1 * | 9/2011 | Lo | 135/24 |
| 2011/0232707 | A1 * | 9/2011 | Wu et al. | 135/22 |

* cited by examiner

*Primary Examiner* — Noah Chandler Hawk

(57) ABSTRACT

The present invention pertains to a protective mechanism for automatic umbrella mainly including a drive unit, a pulley tackle, a spring motor, a clutch, and a clutch spring; wherein, a strand has one end fixed to the pulley tackle and the other end secured to an upper notch of the umbrella, and the spring motor and the clutch are separately mounted on the pulley tackle. Further, between the clutch and the pulley tackle are unidirectional rotor members cooperating with each other. Thus, the drive unit and the clutch spring substantially control the separation and contact of the clutch and the pulley tackle for either releasing the strand and tightening the spring motor while stretching the umbrella or winding the strand in a single direction and loosening the spring motor when collapsing. Therefore, the present invention prevents from striking users by taking off the umbrella stick halfway when manually retracting it.

3 Claims, 10 Drawing Sheets

PROTECTIVE MECHANISM FOR AUTOMATIC UMBRELLA

BACKGROUND OF THE INVENTION

1. Field of the Invention

The present invention generally relates to an automatic opening and closing umbrella structure, more particularly to a protective mechanism for automatic umbrella.

2. Description of the Related Art

Various self opening and closing umbrellas presented in the market essentially apply the button to automatically trigger the stretch and the collapse of the umbrella ribs and manually pull the tubes downwards for retracting the umbrella stick. The conventional umbrella, however, may easily spring the stick back without extremely pulling the tubes downwards to the end, which hence results in hurting users and causing the security leak.

SUMMARY OF THE INVENTION

Therefore, the object of the present invention is to provide a protective mechanism for automatic umbrella which facilitates to prevent the stick from springing back and striking users without entirely compressing the umbrella stick while manually retracting the stick.

The protective mechanism for automatic umbrella in accordance with the present invention mainly comprises a drive unit, a pulley tackle, a spring motor, a clutch, and a clutch spring; wherein, a strand has one end fixed to the pulley tackle and the other end secured to an upper notch of the umbrella. Further, the spring motor is pivoted on the pulley tackle, and the clutch is disposed by the side of the pulley tackle. In addition, unidirectional rotor members able to cooperate with each other are oppositely and respective disposed on the clutch and the pulley tackle. Hence, the drive unit and the clutch spring control the clutch to be either separated from the pulley tackle or be in contact with the pulley tackle, thereby alternatively permitting releasing the strand and tightening the spring motor while stretching the umbrella or winding the strand and loosening the spring motor while manually compressing the umbrella stick to collapse the umbrella. Accompany with the assistance of the unidirectional rotor members, the pulley tackle is allowed to rotate toward a direction to wind and loosen the strand and the spring motor while compressing so as to immediately tighten the strand by restricting the reverse direction of the tackle if taking off the stick halfway.

It is one embodiment that the drive unit, the pulley tackle, the spring motor, the clutch and the clutch spring are mounted within the controlling means; the drive unit, disposed beneath a main stick of the umbrella, has a drive stem cooperating with a hooked head hanged inside the controlling means; the pulley tackle, the clutch and the clutch spring are sequentially located below the drive stem; the clutch is a clutch plate; the clutch plate and the pulley tackle have respective uni-rotary slant gears oppositely disposed at their ends for cooperating with each other; the clutch plate downwardly compresses the clutch spring and takes apart from the pulley tackle for releasing the strand from the pulley tackle and tightening the spring motor while stretching the umbrella to render the hooked head to press the drive stem; the clutch plate is boosted up by the clutch spring to contact with the pulley tackle while collapsing the umbrella to deviate the hooked head from the drive stem and promote the uni-rotary slant gears to rotate in a single direction, thereby winding the strand round the pulley tackle and loosening the spring motor in time of retracting the stick.

It is another embodiment that the drive unit is a drive shield that assembles to an outer circumference of the controlling means and slidably moves along the controlling means; the pulley tackle, the spring motor, the clutch, and the clutch spring are mounted within the controlling means, and the clutch and the clutch spring are located below the pulley tackle; the clutch is a clutch plate; the clutch spring has both ends respectively directing against the clutch plate and a bottom side of the drive shield; the clutch plate and the pulley tackle have respective uni-rotary slant gears oppositely disposed at their ends for cooperating with each other; the clutch plate is downwardly pressed to separate from the pulley tackle for releasing the strand from the pulley tackle and tightening the spring motor while stretching the umbrella to downwardly slide the drive shield on the controlling means; the clutch plate is boosted up by the clutch spring to contact with the pulley tackle while collapsing the umbrella to upwardly slide the drive shield on the controlling means and promote the uni-rotary slant gears to rotate in a single direction, thereby winding the strand round the pulley tackle and loosening the spring motor in time of retracting the stick.

wherein, a marble is embedded into a side wall of the controlling means and alternatively inserted through an upper aperture and a lower aperture that are defined on a side surface of the drive shield; a protrusion is further formed at an inner surface of the drive shield, so that the clutch plate is compressed by the protrusion to separate from the pulley tackle while pushing the marble into the upper aperture, and the clutch plate is boosted up by the clutch spring to contact with the pulley tackle while pulling the marble into the lower aperture.

It is also another embodiment that the drive unit, the pulley tackle, the spring motor, the clutch and the clutch spring are mounted within the controlling means; the drive unit, disposed beneath a main stick of the umbrella, has a drive stem cooperating with a hooked head hanged inside the controlling means; the pulley tackle is configured by a ratchet, and the clutch is a pawl propped against the drive stem by the clutch spring, whereby the drive stem is able to control the separation or the contact of the pawl and the ratchet; the pawl compresses the clutch spring to separate from the pulley tackle for releasing the strand from the pulley tackle and tightening the spring motor while stretching the umbrella to permit the hooked head downwardly pressing the drive stem; the pawl is boosted up by the clutch spring to contact with the pulley tackle while collapsing the umbrella to deviate the hooked head from the drive stem, thereby winding the strand round the pulley tackle and loosening the spring motor in time of retracting the stick Wherein, the aforementioned strand has its other end penetrating through an opening defined on a side wall of the controlling means for straight securing to the upper notch of the umbrella.

Wherein, the aforementioned strand has its other end joined to a rope hanged in a hooked head for extensibly securing to the upper notch via the rope.

Therefore, the above elements herein are adopted to be mounted within the controlling means. In operation, the pulley tackle merely performs in a single rotation by the restriction of the unidirectional rotor members to either release the strand and tighten the spring motor While stretching the umbrella or wind the strand and loosen the spring motor when collapsing. Therefore, the present invention prevents from striking users by taking off the umbrella stick halfway and hurting users when manually retracting it and achieves the security defense.

The advantages of the present invention over the known prior arts will become more apparent to those of ordinary skilled in the art by reading the following descriptions with the relating drawing.

DETAILED DESCRIPTION OF THE PREFERRED EMBODIMENTS

Figure 1:
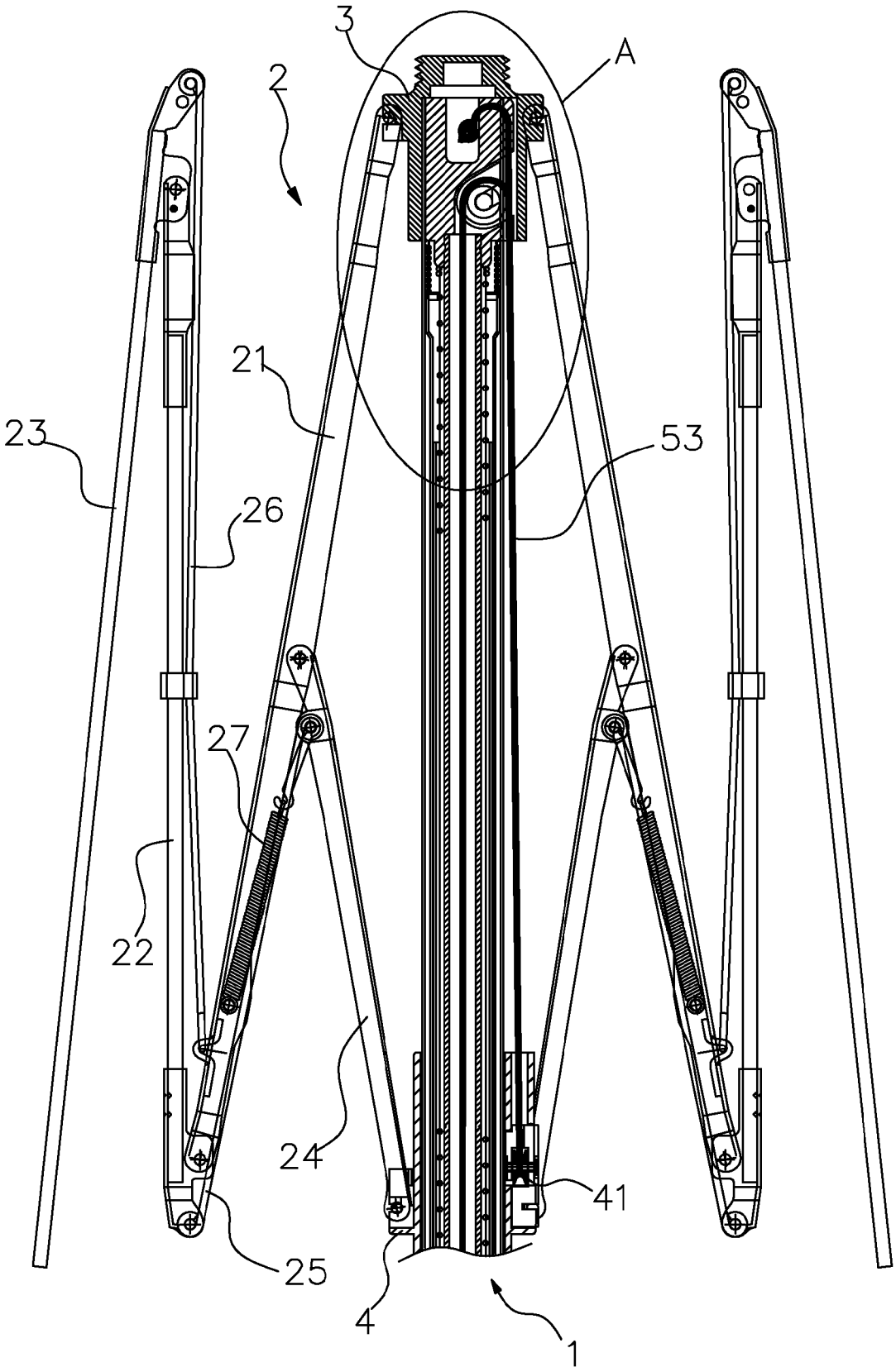
FIG. 1 is a longitudinal view showing a collapsible rib assembly of the present invention.

Before the present invention is described in greater detail, it should be noted that the like elements are denoted by the same reference numerals throughout the disclosure.

Figure 3:
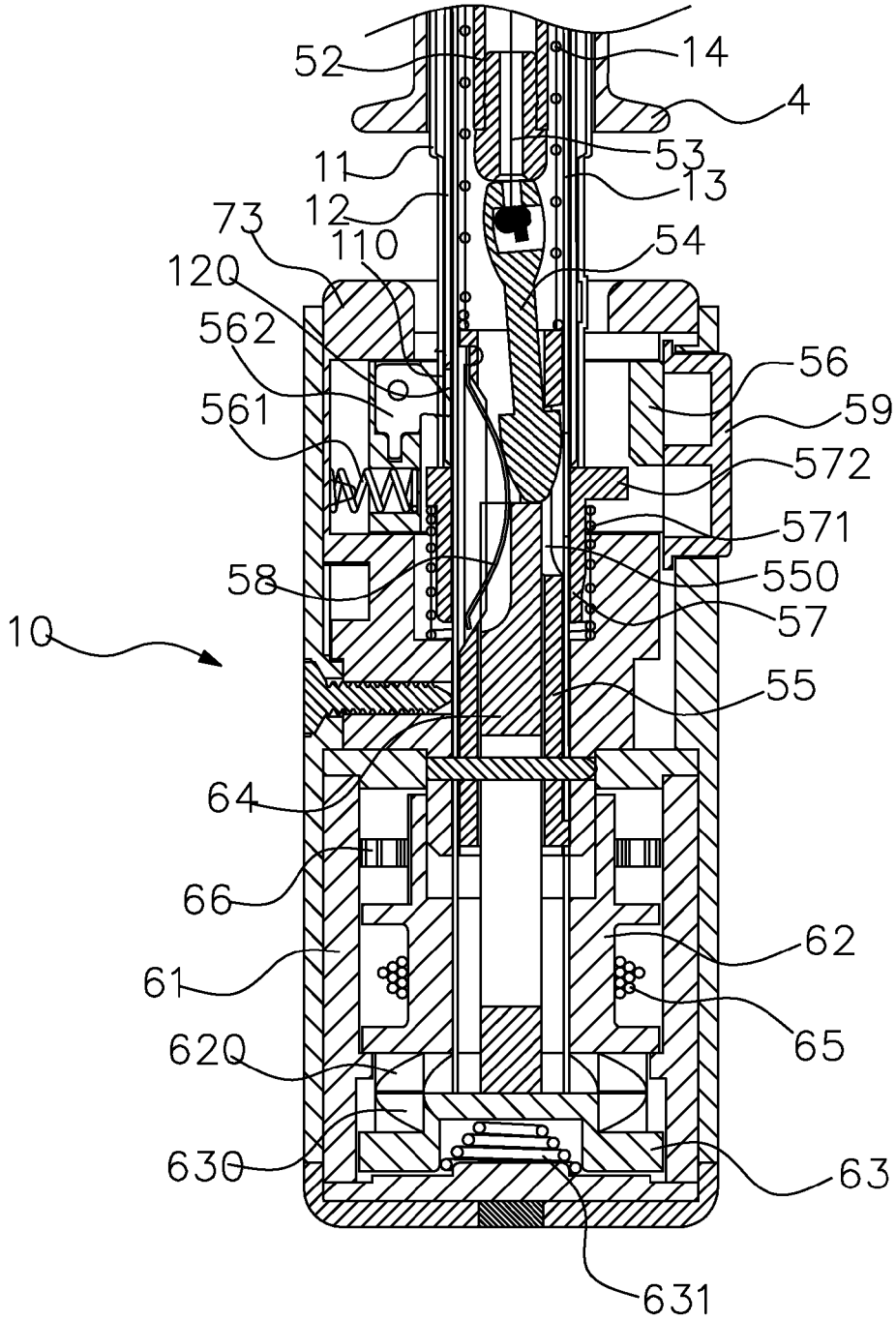
FIG. 3 is a longitudinal view showing a first preferred embodiment of the present invention.

Referring to FIG. 1 and FIG. 3, an automatic umbrella of a first preferred embodiment of the present invention integrally includes a telescopic stick 1 and a collapsible rib assembly 2; wherein, the stick 1 has a lower runner 4 slidably disposed thereon, an upper notch 3 located at its top end, and a controlling means 10 disposed at its lower end. The rib assembly 2 is attached to the stick 1 via the upper notch 3 and the lower runner 4.

Still further, the rib assembly 2 comprises a main rib 21, a lower rib 24, a middle rib 22, an external rib 23, a connecting rib 25, and a resilient rib 26; wherein, the main rib 21 has its innermost end pivoted to the upper notch 3 and its outermost end connected to an inner portion of the middle rib 22; the lower rib 24 has its innermost end secured to the lower runner 4 and its outermost end engaged to a central portion of the main rib 21. Further, the middle rib 22 has its outermost end connected to an inner portion of the external rib 23; the connecting rib 25 provides with its inner portion affixed to an outer portion of the lower rib 24 and its outer portion connected to an innermost end of the middle rib 22; the resilient rib 26 provides with its inner portion pivoted to an outer portion of the main rib 21, its outer portion engaged to an innermost end of the external rib 23, and its central portion slidably engaged to a central portion of the middle rib 22. Additionally, a retraction restoring spring 27 is disposed between the inner portion of the lower rib 24 and the outer portion of the main rib 21.

Figure 2:
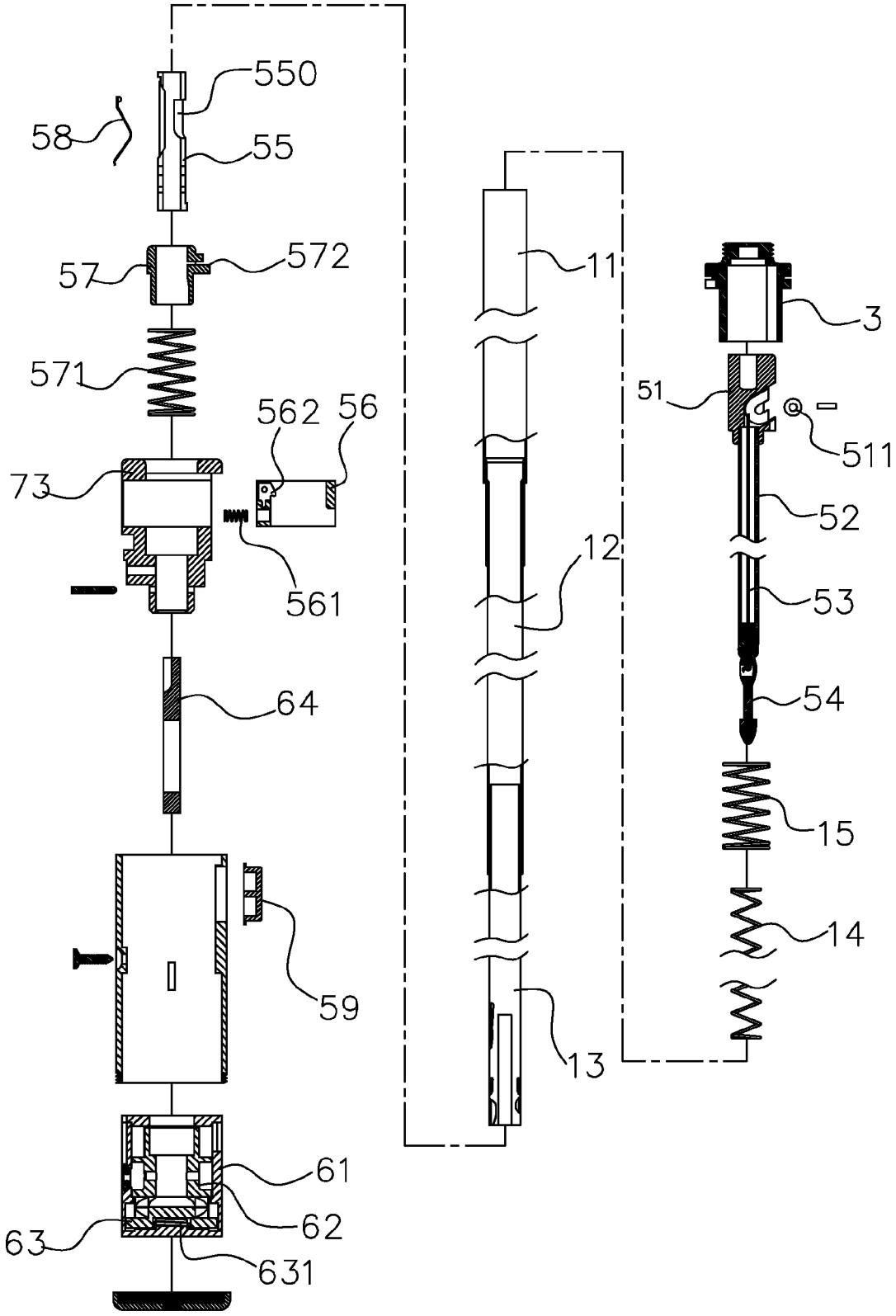
FIG. 2 is an exploded view showing the present invention.

Referring to FIGS. 1 and 2, the telescopic stick 1 consists of an external tube 11, a middle tube 12 telescoped in the tube 11, and an interior tube 13 slided over the tube 12; wherein, a, main spring 14 is mounted within the stick 1 for driving those tubes 11, 12, 13. Further, the upper notch 3 is positioned at the apex of the external tube 11, the controlling means 10 is disposed in the bottom of the interior tube 13, and the lower runner 4 is slidably mounted around an outer circumference of the external tube 11, whereby the external tube 11 would be on the upper portion and the interior tube 13 would be on the lower portion while stretching the telescopic stick 1.

Figure 6:
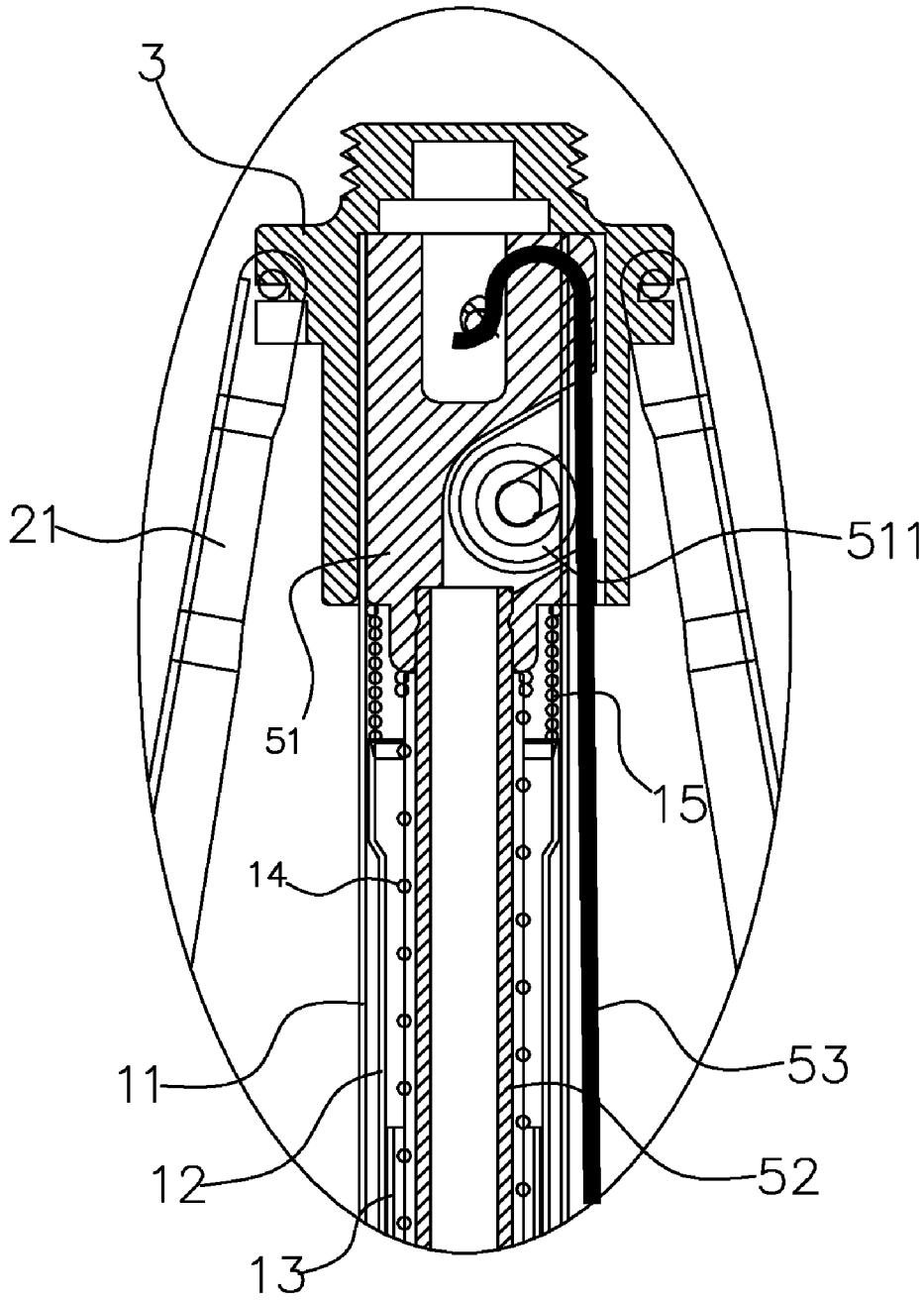
FIG. 6 is an enlarged view showing the portion of "A" in FIG. 1.

Further referring to FIGS. 2, 3, and 6, a pulley base 51 is embedded into the upper notch 3 and engaged with a shoulder stem 52 that extends downwards from the bottom of the pulley base 51. Both the pulley base 51 and the lower runner 4 respectively have a guiding pulley 511 and a runner pulley 41. A rope 53 additionally fixes its one end to the pulley base 51, downwardly passes around the runner pulley 41, upwardly convolves the guiding pulley 511, and thence goes through the shoulder stem 52. The rope thus has its end bore against a hooked head 54, which is fitly positioned in a blocking place where a resilient plate 58 is located. Furthermore, the controlling means 10 has a latch rod 562 disposed therein, two latch holes 110, 120 separately defined on lower portions of the external tube 11 and the middle tube 12 for interposing the latch rod 562 therein, and a button 59 for pushing the latch rod 562 apart from the holes 110, 120 and deviating the hooked head 54 from the blocking place.

Continuing with the aforesaid, a button base 73 assembled in the controlling means 10 has a button tap 56 swinging therein and a button spring 561 disposed between the outer circumference of the button tap 56 and the inner wall of the button base 73 for driving the movement of the button tap 56. The latch rod 562 is thence located at a site opposite to the button tap 56 for corresponding with the holes 110, 120. In addition, the button 59 is protruded from the controlling means 10 and disposed against the button tap 56, so that the button 59 withstands the resilience of the button spring 561 to deviate the latch rod 562 from the latch holes 110, 120.

A blocking sleeve 55 is axially mounted inside the controlling means 10, and a head socket 550 is recessed in the side wall of the blocking sleeve 55 and formed of the blocking place for accommodating the hooked head 54. The resilient plate 58 is further disposed inside the sleeve 55 and located at the site opposite to the head socket 550. Further, a movable shield 57 covering the blocking sleeve 55 directs against the bottom side of the external tube 11 and the middle tube 12 while retracting the stick 1 and includes a drive spring 571 to propel the shield 57 toward the head socket 550 and a protrusion 572 fitted with the inner wall of the button tap 56, whereby the movable shield 57 takes apart from the external tube 12 and the middle tube 12 and slides upwards by the susceptibility of the resilience of the drive spring 571 while stretching the stick 1. The movable shield 57 can also push the hooked head 54 to leave the head socket 550 while triggering the button 59 to depress the protrusion 572 by the button tap 56.

The main spring 14 is disposed around the shoulder stem 52 and located between the bottom side of the pulley base 51 and the top end of the blocking sleeve 55. Further referring to FIG. 6, a protective spring 15 is disposed between the top end of the middle tube 12 and the bottom side of the pulley base 51 for the buffer effect while retracting the stick 1.

Additionally, the controlling means 10 particularly provides with a protective mechanism which consists of a drive unit, a pulley tackle 62, a spring motor 66, a clutch, and a clutch spring 631. The drive unit is a drive stem 64, and the clutch is adopted by a clutch plate 63. The drive stem 64, the pulley tackle 62, the spring motor 66, the clutch plate 63 and the clutch spring 631 are sequentially mounted within the controlling means 10. Wherein, the drive stem 64 is disposed beneath the stick 1 and depressed by the hooked head 54 of the controlling means 10; the pulley tackle 62 thence pivots to the lower portion of the drive stem 64 and allows a strand 65 to have one end affixed thereto and the other end secured to the upper notch 3 by straight passing through an opening defined within a side wall of the controlling means 10. Further, The spring motor 66 is assembled to and driven by the pulley tackle 62, namely rotating the pulley tackle 62 toward a clockwise direction to tighten the spring motor 66 and oppositely rotating toward a counterclockwise direction to loosen it. The clutch plate 63 is disposed under the pulley tackle 62, and the clutch plate 63 and the clutch spring 631 are located under the drive stem 64 in sequence, so that the clutch spring 631 drives the clutch plate 63 moving upwards toward the direction of the pulley tackle 62, and the drive stem 64 reversely propel the clutch plate 63 to separate from the pulley tackle 62. The clutch plate 63 and the pulley tackle 62 both have respective unidirectional rotor members to be disposed at opposite faces thereof for cooperating with each other; herein uni-rotary slant gears 620, 630 are shown in FIG. 6 and adopted in the preferred embodiments.

Still, a tackle sleeve 61 is assembled under the button base 73; wherein, the pulley tackle 62 is rotarily disposed on the upper portion of the tackle sleeve 61, and the clutch plate 63 is slidably disposed on the lower portion thereof. Further, the clutch spring 631 is mounted between the bottom side of the clutch plate 63 and the inner side of the tackle sleeve 61. In this preferred embodiment, the drive stem 64 has its upper portion slidably disposed in the blocking sleeve 55 and its lower portion directing against the top end of the clutch plate 63 by passing through the pulley tackle 62. Therefore, the clutch plate 63 subjected to the propulsion of the drive stem 64 is separated from the pulley tackle 62 while the hooked head 54 is fitly interposed in the head socket 550 to press the drive stem 64 downwards, whereby the pulley tackle 62 can be freely rotated; relatively, the clutch plate 63 is boosted toward the pulley tackle 62 by the clutch spring 631 while the hooked head 54 is deviated from the socket 550 to stop pressing the drive stem 64.

While stretching the umbrella, as shown in FIG. 3, the button 59 is initially depressed to take the latch rod 562 apart from the latch holes 110, 120. Then, the main spring 14 is motivated to extend the stick 1, tension the rope 53, and thence pull the lower runner 4 upwards for opening the rib assembly 2. Simultaneously, the movable shield 57 that is no longer compressed by the middle tube 12 and the external tube 11 directly slides to the head socket 550 via the assistance of the drive spring 571, therefore the drive stem 64 can be depressed by the hooked head 54 to separate the clutch plate 63 from the pulley tackle 62. The strand 65 thus is pulled upwards via the upper notch 3 to substantially rotate the pulley tackle 62 and tighten the spring motor 66.

Figure 7:
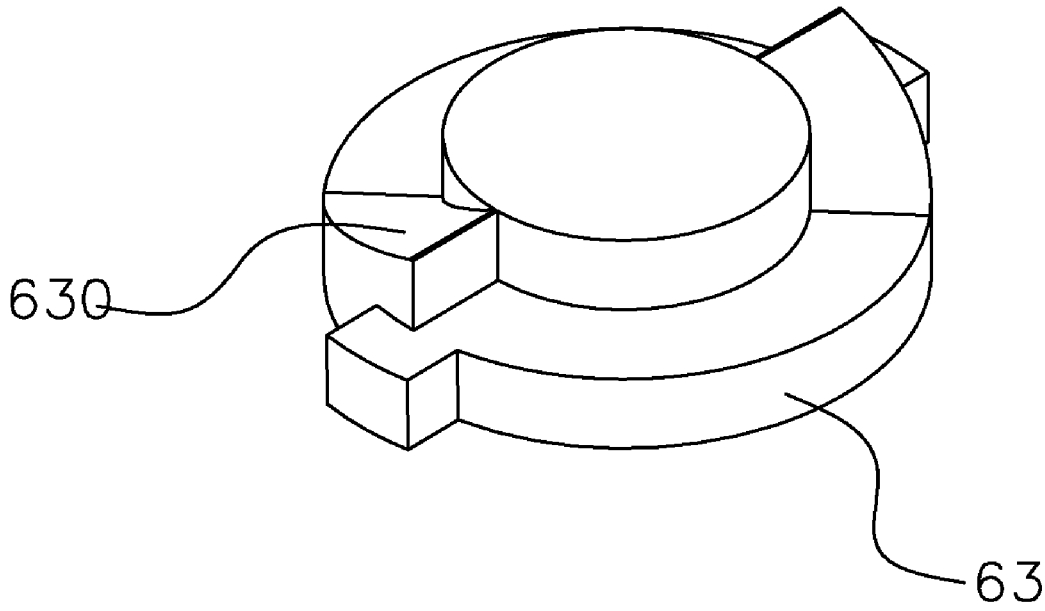
FIG. 7 is a perspective view showing a clutch plate structure of the present invention.

Both referring to FIGS. 3 and 7, while collapsing the umbrella, the button 59 is also depressed to push the hooked head 54 away from the head socket 550. Then, the rope 53 is released to slide the lower runner 4 downwards under the resilience of the retraction restoring spring 27 for closing the rib assembly 2. Simultaneously, the clutch plate 63 that is no longer compressed by the hooked head 54 in turn moves toward the bottom side of the pulley tackle 62 via the clutch spring 631. In this manner, the slant gear 630 of the clutch plate 63 fits and oppositely operates with the slant gear 620 of the pulley tackle 62 to render the pulley tackle 62 to rotate toward a single direction. Thus, the tackle 62 is counterclockwise rotated to wind the strand 65 thereon by loosening the spring motor 66 while manually retracting the stick 1. If the stick 1 is taken off halfway in phase of retracting, the pulley tackle would in turn tension the strand 65 and restrict the reverse rotation to render the stick 1 unable to spring backwards, thereby achieving the security defense.

Figure 4:
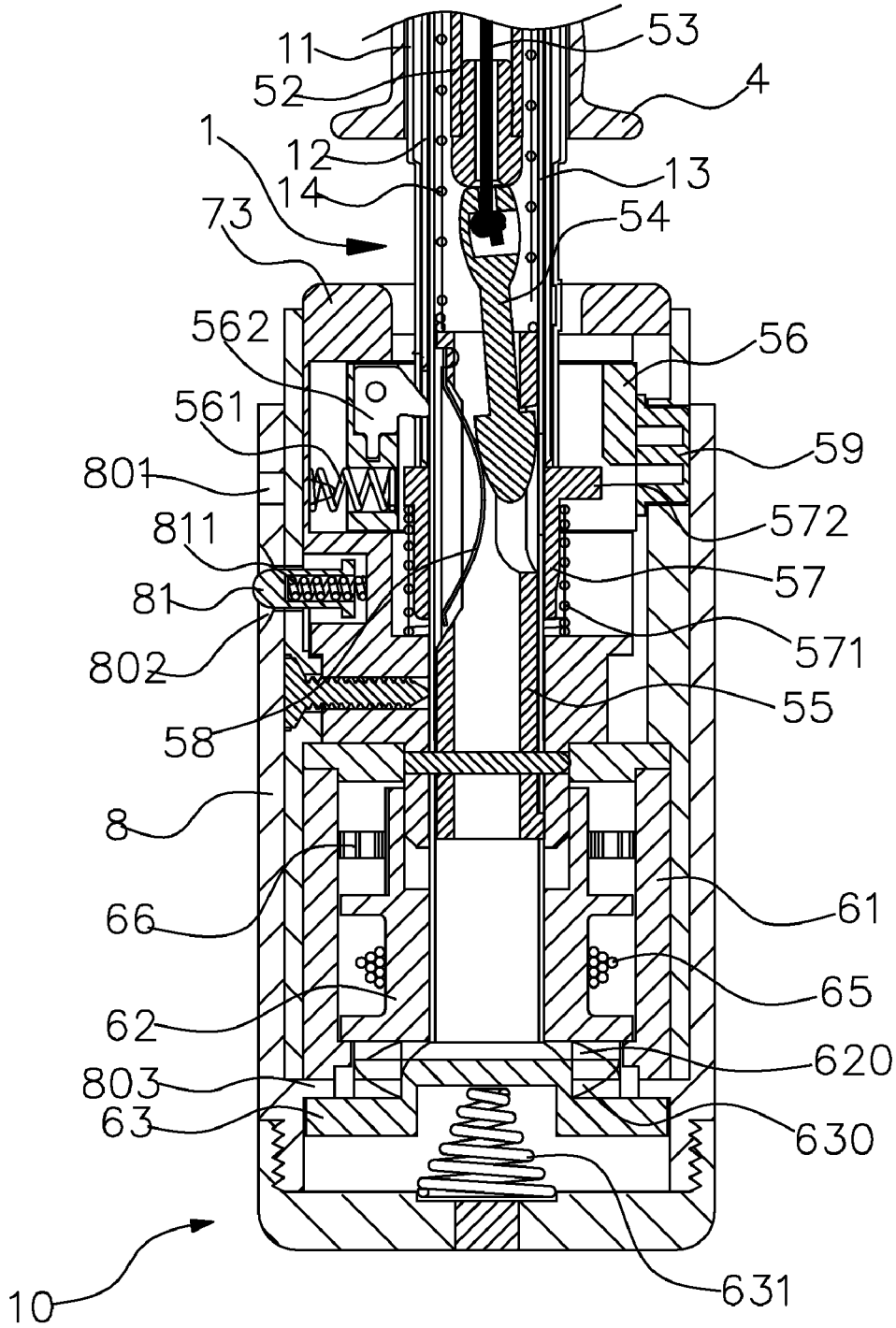
FIG. 4 is a schematic view showing a second preferred embodiment of the present invention when folded.
Figure 5:
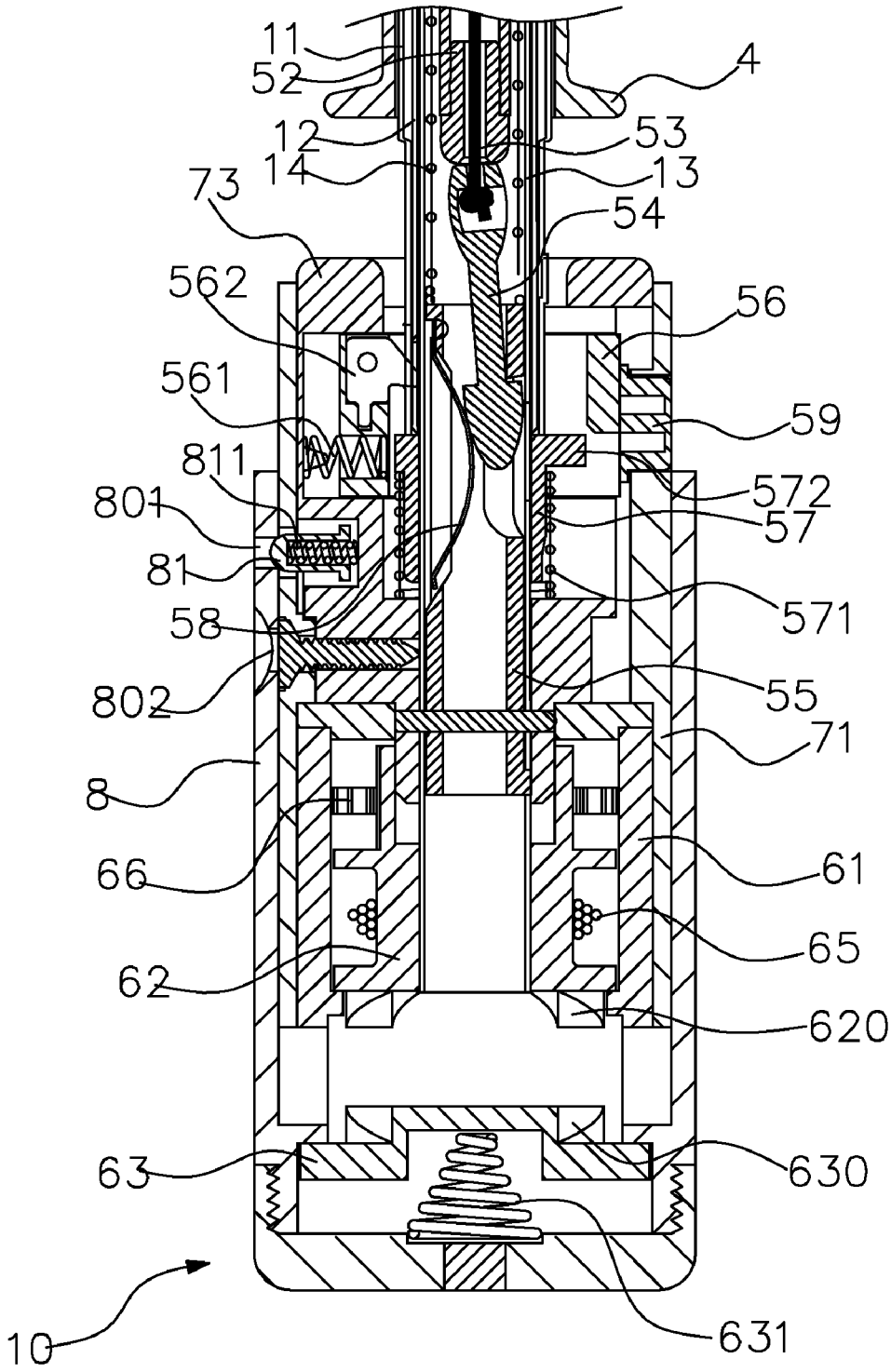
FIG. 5 is a schematic view showing a second preferred embodiment of the present invention when opened.

Referring to FIGS. 1, 4, and 5, a second preferred embodiment of the present still comprises the essential elements as the same as the first embodiment. Differentially, the drive unit is a drive shield 8 that assembles to an outer circumference of the controlling means 10 and slidably moves along it; further, the clutch plate 63 is mounted at the bottom side of the drive shield 8, and the clutch spring 631 has both ends respectively directing against the clutch plate 63 and the bottom side of the drive shield 8. The drive shield 8 further provides with a marble 81 embedded into a side wall of the controlling means 10 and a marble spring 811 for propelling the marble 81; wherein, the marble 81 is alternatively inserted through an upper aperture 801 and a lower aperture 802 that are defined on a side surface of the drive shield 8, and a protrusion 803 is further formed at an inner surface of the drive shield 8 to compress the clutch plate 63.

Referring to FIG. 5, while in operation, the drive shield 8 slides downwards along the controlling means 10 to separate the clutch plate 63 from the pulley tackle 62 and to expose the button 59 to the outside. Users thus can trigger the button 59 to open or close the rib assembly 2 as describing in the first embodiment. Further referring to FIG. 4, the drive shield 8 slides upwards to boost the clutch plate 63 upwards to the pulley tackle 62 and hides the button 59 to avoid the false touch, so as to prevent the stick 1 from being sprung backwards while taking the stick 1 off halfway in time of retracting.

Figure 8:
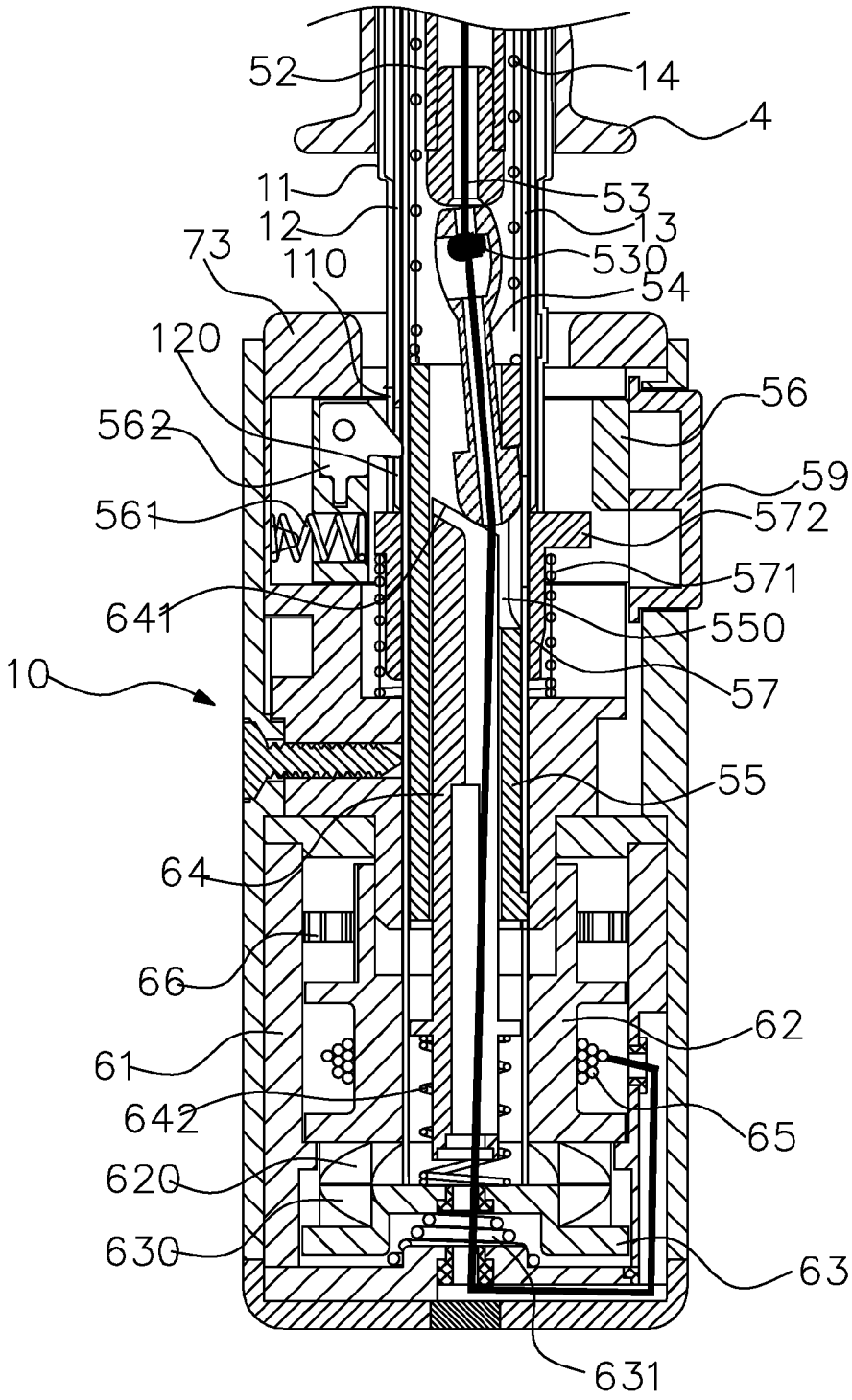
FIG. 8 is an longitudinal view showing a third preferred embodiment of the present invention.

Referring to FIGS. 1 and 8, it still includes the essential elements as the same as the first embodiment. Particularly, the strand 65 has one end affixed to the pulley tackle 62 and the other end passing through a side wall of the tackle sleeve 61, across the bottom side, thence through clutch plate 63, the pulley tackle 62, the drive stem 64, and then connecting to the rope 53. The rope 53 has a rope knot 530 knotted round the connection and extends upwards through the hooked head 54, so that the strand 65 is formed integral with the rope 53 without exposing out of the stick 1.

Furthermore, a spring 642 is disposed between the drive stem 64 and the clutch plate 63; the drive stem 64 provides with a slant end 641 contacting with the hooked head 54 to render the head 54 interposing into the head socket 550, so that the cooperation of the slant end 641 and the spring 642 can replace the resilient plate 58 of the first embodiment.

While stretching the umbrella, the button 59 is initially depressed to take the latch rod 562 apart from the latch holes 110, 120. Then, the main spring 14 is motivated to extend the stick 1, tension the rope 53, and pull the lower runner 4 upwards for opening the rib assembly 2. Thereafter, the movable shield 57 no longer compressed by the middle tube 12 and the external tube 11 directly slides to the head socket 550 via the drive spring 571, therefore the drive stem 64 is depressed by the hooked head 54 to separate the clutch plate 63 from the pulley tackle 62. The strand 65 thus is pulled upwards via the upper notch 3.

Both referring to FIGS. 7 and 8, while collapsing the umbrella, the button 59 is also depressed to push the hooked head 54 away from the head socket 550. Then, the rope 53 is released to slide the lower runner 4 downwards under the resilience of the retraction restoring spring 27 for closing the rib assembly 2. Simultaneously, the strand 65 is pulled upwards by the hooked head 54 to drive the pulley tackle 62 rotated and tighten the spring motor 66. The clutch plate 63 devoid of the compression of the hooked head 54 hence moves toward the bottom side of the pulley tackle 62 via the clutch spring 631. In this manner, the slant gear 630 of the clutch plate 63 fits and oppositely operates with the slant gear 620 of the pulley tackle 62 to render the pulley tackle 62 to rotate toward a single direction. Thus, the tackle 62 is counterclockwise rotated to wind the strand 65 thereon by loosening the spring motor 66 while manually retracting the stick 1. If the stick 1 is taken off halfway in phase of retracting, the pulley tackle 62 would in turn tension the strand 65 and restrict the reverse rotation to render the stick 1 unable to spring backwards, thereby achieving the security defense.

Figure 10:
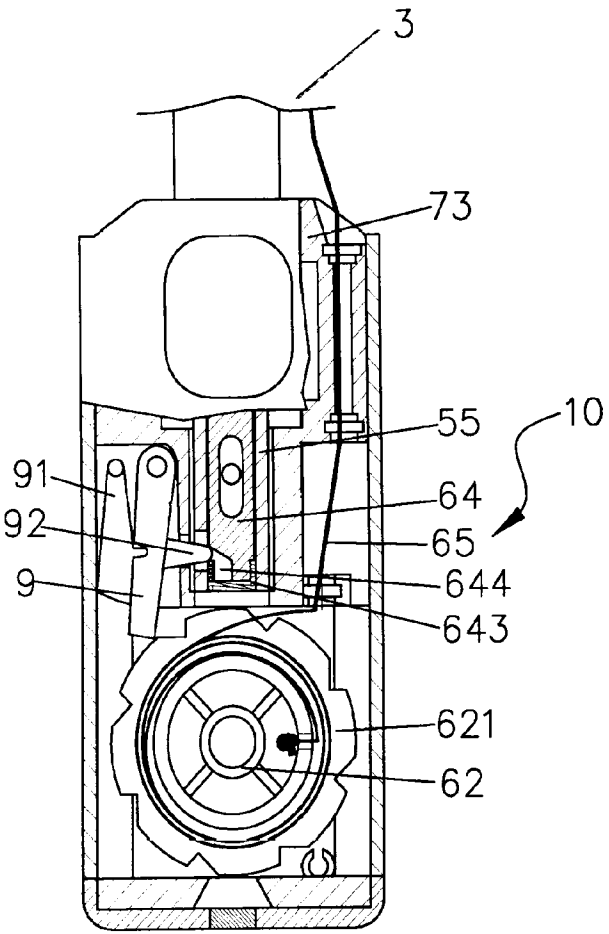
FIG. 10 is a side view showing of FIG. 9.
Figure 9:
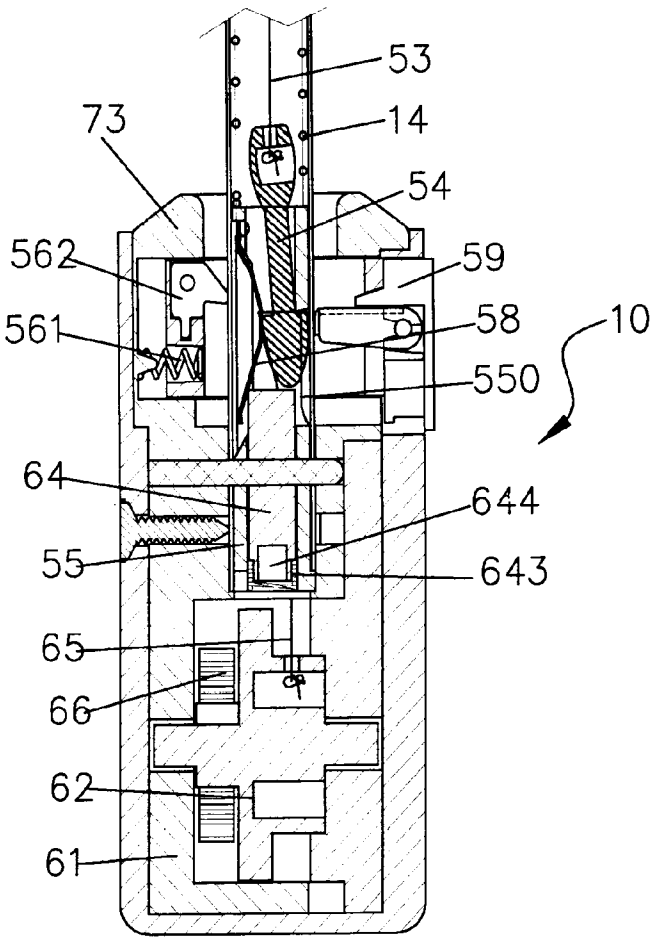
FIG. 9 is a schematic view showing a fourth preferred embodiment of the present invention when opened.

Referring to FIGS. 1, 9, and 10, it still includes the essential elements as the same as the first embodiment. Particularly, the drive stem 64 has a stem spring 643 disposed thereunder and a concavity 644 for controlling the clutch, so that the drive stem 64 can be compressed downwards by the hooked head 54 and boosted upwards by the stem spring 643. Furthermore, the clutch is a pawl 9 that includes a pawl rod 92 fitting to the concavity 644; the clutch spring is a pawl spring 91, and the pulley tackle 62 is configured by a ratchet 621.

Referring to FIGS. 9 and 10, while stretching the umbrella, the button 59 is initially depressed to take the latch rod 562 apart from the latch holes 110, 120. Then, the main spring 14 is motivated to extend the stick 1, tension the rope 53, and pull the lower runner 4 upwards for opening the rib assembly 2. Thereafter, the movable shield 57 no longer compressed by the middle tube 12 and the external tube 11 directly slides to the head socket 550 via the drive spring 571, therefore the drive stem 64 is depressed by the hooked head 54 to separate the pawl 9 from the pulley tackle 62. The strand 65 thus is pulled upwards via the upper notch 3 to rotate the pulley tackle 62 and tighten the spring motor 66.

Figure 12:
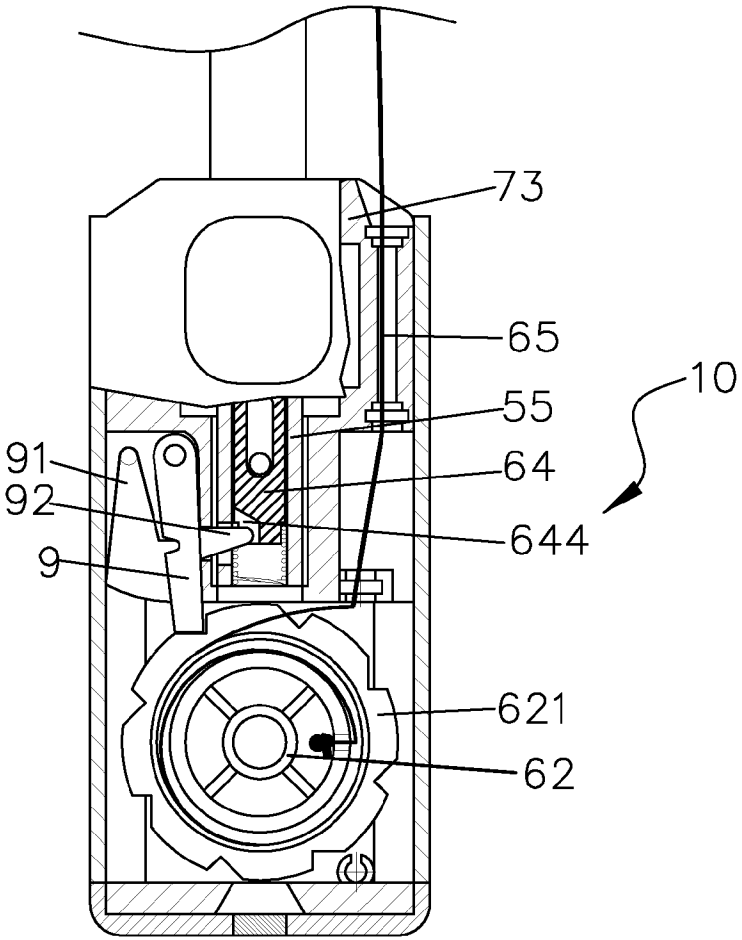
FIG. 12 is a side view showing of FIG. 11.
Figure 11:
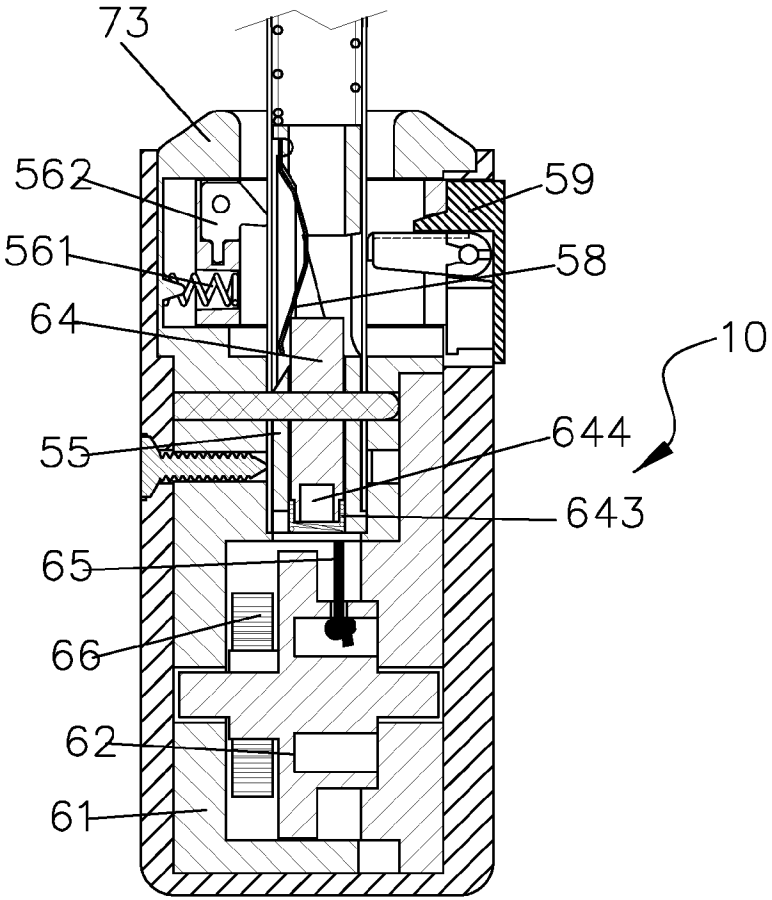
FIG. 11 is a schematic view showing a fourth preferred embodiment of the present invention when folded.

Referring to FIGS. 11 and 12, while collapsing the umbrella, the button 59 is also depressed to push the hooked head 54 away from the head socket 550. Then, the rope 53 is released to slide the lower runner 4 downwards under the resilience of the retraction restoring spring 27 for closing the rib assembly 2. Simultaneously, the drive stem 64 that is no longer compressed by the hooked head 54 in turn moves upwards by the stem spring 643. In this manner, the pawl 9 fitly contacts with the ratchet 621 so as to render the pulley tackle 62 to rotate toward a single direction. Thus, the pulley tackle 62 is counterclockwise rotated to wind the strand 65 thereon by loosening the spring motor 66 while manually retracting the stick 1. If the stick 1 is taken off halfway in phase of retracting, the pulley tackle 62 would in turn tension the strand 65 and restrict the reverse rotation to render the stick 1 unable to spring backwards, thereby achieving the security defense.

To sum up, the present invention takes advantages of the drive unit and the clutch spring to control the separation or the contact of the pulley tackle and the clutch. By means of the unidirectional rotor members on the clutch and the tackle, the pulley tackle merely rotates toward a single direction while fitting the clutch with it and accompanies the strand to restrict the reverse rotation, whereby the present invention facilitates to prevent the backward movement of the stick from striking users while taking the stick off halfway in time of retracting and increase the security defense.

While we have shown and described the embodiment in accordance with the present invention, it should be clear to those skilled in the art that further embodiments may be made without departing from the scope of the present invention.

I claim:

1. A protective mechanism for automatic umbrella comprising a drive unit, a pulley tackle, a spring motor, a clutch, and a clutch spring respectively assembled to a controlling means of said umbrella; wherein, a strand passing around said pulley tackle and providing with one end thereof affixed to said pulley tackle and with the other end thereof secured to an upper notch of said umbrella; said spring motor being mounted on said pulley tackle, and said clutch being disposed adjacent to said pulley tackle; unidirectional rotor members being respectively and oppositely located on said clutch and said pulley tackle for cooperating with each other; said drive unit and said clutch spring respectively controlling a separation and a contact of said clutch and said pulley tackle; said clutch being separated from said pulley tackle to release said strand from said pulley tackle and tighten said spring motor while stretching said umbrella; said clutch being in contact with said clutch to promote a cooperation between said unidirectional rotor members while collapsing said umbrella, thereby in turn winding said strand round said pulley tackle and loosening said spring motor in time of retracting a stick of said umbrella.

2. The protective mechanism for automatic umbrella as claimed in claim 1, wherein, said drive unit, said pulley tackle, said spring motor, said clutch and said clutch spring are mounted within said controlling means; said drive unit, disposed beneath a main stick of said umbrella, has a drive stem cooperating with a hooked head hanged inside said controlling means; said pulley tackle is configured by a ratchet, and said clutch is a pawl propped against said drive stem by said clutch spring, whereby said drive stem is able to control the separation or the contact of said pawl and said ratchet; said pawl compresses said clutch spring to separate from said pulley tackle for releasing said strand from said pulley tackle and tightening said spring motor while stretching said umbrella to permit said hooked head downwardly pressing said drive stem; said pawl is boosted up by said clutch spring to contact with said pulley tackle while collapsing said umbrella to deviate said hooked head from said drive stem, thereby winding said strand round said pulley tackle and loosening said spring motor in time of retracting said stick.

3. The protective mechanism for automatic umbrella as claimed in claim 1, wherein, said strand has its other end penetrating through an opening defined on a side wall of said controlling means for straight securing to said upper notch of said umbrella.

* * * * *